US011567443B1

(12) United States Patent
Boettcher et al.

(10) Patent No.: US 11,567,443 B1
(45) Date of Patent: Jan. 31, 2023

(54) ELECTRICAL CONTACT BETWEEN A ROTATABLE SHAFT AND A STATIONARY BUSHING

(71) Applicant: LEXMARK INTERNATIONAL, INC., Lexington, KY (US)

(72) Inventors: Brian Lester Boettcher, Versailles, KY (US); Bartley Charles Gould, II, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 17/573,982

(22) Filed: Jan. 12, 2022

Related U.S. Application Data

(60) Provisional application No. 63/289,324, filed on Dec. 14, 2021.

(51) Int. Cl.
*G03G 21/16* (2006.01)

(52) U.S. Cl.
CPC ..... *G03G 21/1652* (2013.01); *G03G 21/1676* (2013.01)

(58) Field of Classification Search
CPC ..... G03G 21/1652; G03G 21/1676
USPC ..... 399/111, 262
See application file for complete search history.

(56) References Cited

U.S. PATENT DOCUMENTS

2009/0203233 A1 8/2009 Gayne et al.

FOREIGN PATENT DOCUMENTS

JP H10123918 * 5/1998

* cited by examiner

*Primary Examiner* — Hoan H Tran
(74) *Attorney, Agent, or Firm* — Justin M. Tromp

(57) ABSTRACT

An electrical contact according to one example embodiment includes a body composed of an electrically conductive material. The body has an axially inboard side and an axially outboard side. An opening through the body is configured to closely receive a shaft of a rotatable component. A mounting tab extends from the axially outboard side of the body for attaching the body to a rotatable gear to rotatably couple the electrical contact to the gear. A contact arm extends in a cantilevered manner from the axially inboard side of the body for contacting a bushing that rotatably supports the shaft to provide an electrical connection between the bushing and the shaft.

17 Claims, 6 Drawing Sheets

ELECTRICAL CONTACT BETWEEN A ROTATABLE SHAFT AND A STATIONARY BUSHING

CROSS REFERENCES TO RELATED APPLICATIONS

This application claims priority to U.S. Provisional Patent Application Ser. No. 63/289,324, filed Dec. 14, 2021, entitled "Electrical Contact. Between a Rotatable Shaft and a Stationary Bushing," the content of which is hereby incorporated by reference in its entirety.

BACKGROUND

1. Field of the Disclosure

The present disclosure relates generally to electrical connections and more particularly to electrical contact between a rotatable shaft and a stationary bushing.

2. Description of the Related Art

During a print operation by an electrophotographic image forming device, a charge roll charges the surface of a photoconductive drum to a predetermined voltage. The charged surface of the photoconductive drum is then selectively exposed to a laser light source to selectively discharge the surface of the photoconductive drum and form an electrostatic latent image on the photoconductive drum corresponding to the image being printed. Toner is picked up by the latent image on the photoconductive drum from a developer roll, creating a toned image on the surface of the photoconductive drum. The toned image is then transferred from the photoconductive drum to the print media, either directly by the photoconductive drum or indirectly by an intermediate transfer member. A cleaning blade or roll removes any residual toner adhering to the photoconductive drum after the toner is transferred from the photoconductive drum. The cleaned surface of the photoconductive drum is then ready to be charged again and exposed to the laser light source to continue the printing cycle.

Various imaging components, such as the photoconductive drum, charge roll, developer roll, etc., require electrical voltage from a power supply of the image forming device in order to electrostatically move toner from one component to another, such as from the developer roll to the latent image on the surface of the photoconductive drum and from the surface of the photoconductive drum to the print media or intermediate transfer member. Print defects may occur if electrical contact to these imaging components is not consistently maintained, such as if electrical contact is interrupted or shorted. Maintaining consistent electrical connections to moving components, such as rotating components, can be particularly challenging in comparison with providing electrical connections to stationary components.

Accordingly, it is desired to maintain consistent electrical connections to imaging components requiring an electrical voltage in order to permit continued operation and to avoid print defects. It is desired to provide robust and effective electrical connections while also minimizing cost.

SUMMARY

An assembly according to one example embodiment includes a rotatable component having an electrically conductive shaft that defines a rotational axis of the rotatable component. A gear is mounted on and rotatable with the shaft. An electrically conductive bushing rotatably supports the shaft. An electrical contact is positioned between the bushing and the gear. The electrical contact is composed of an electrically conductive material and contacts the shaft and the bushing to provide an electrical connection between the shall and the bushing. The shaft of the rotatable component extends through an opening in the electrical contact.

Embodiments include those wherein the electrical contact includes a contact arm that extends in a cantilevered manner toward the bushing and contacts the bushing. In some embodiments, the contact arm extends axially along the rotational axis toward the bushing and circumferentially counter to an operative rotational direction of the shaft and the gear allowing the contact arm to clear debris from the bushing when the electrical contact rotates in the operative rotational direction of the shaft and the gear. In some embodiments, the electrical contact includes a plurality of contact arms, and each of the plurality of contact arms extends in a cantilevered manner toward the bushing and contacts the bushing.

Embodiments include those wherein the electrical contact includes a mounting tab that extends axially relative to the rotational axis toward the gear. The mounting tab attaches the electrical contact to the gear such that the electrical contact is rotatably coupled to the gear. In some embodiments, the mounting tab includes a pair of arms extending axially relative to the rotational axis toward the gear. In some embodiments, the arms receive a support rib of the gear therebetween to attach the electrical contact to the gear.

In some embodiments, the electrical contact is positioned between an axially inboard side of the gear and an axially outboard side of the bushing.

An electrical contact according to one example embodiment includes a body composed of an electrically conductive material. The body has an axially inboard side and an axially outboard side. An opening through the body is configured to closely receive a shaft of a rotatable component. A mounting tab extends from the axially outboard side of the body for attaching the body to a rotatable gear to rotatably couple the electrical contact to the gear. A to contact arm extends in a cantilevered manner from the axially inboard side of the body for contacting a bushing that rotatably supports the shaft to provide an electrical connection between the bushing and the shaft.

In some embodiments, the mounting tab includes a pair of arms extending in a cantilevered manner from the axially outboard side of the body for receiving a corresponding support rib of the gear to attach the body to the gear.

In some embodiments, the contact arm extends axially along a rotational axis of the electrical contact and circumferentially counter to an operative rotational direction of the electrical contact.

In some embodiments, the contact arm includes a plurality of contact arms, each of the plurality of contact arms extends in a cantilevered manner from the axially inboard side of the body for contacting the bushing.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
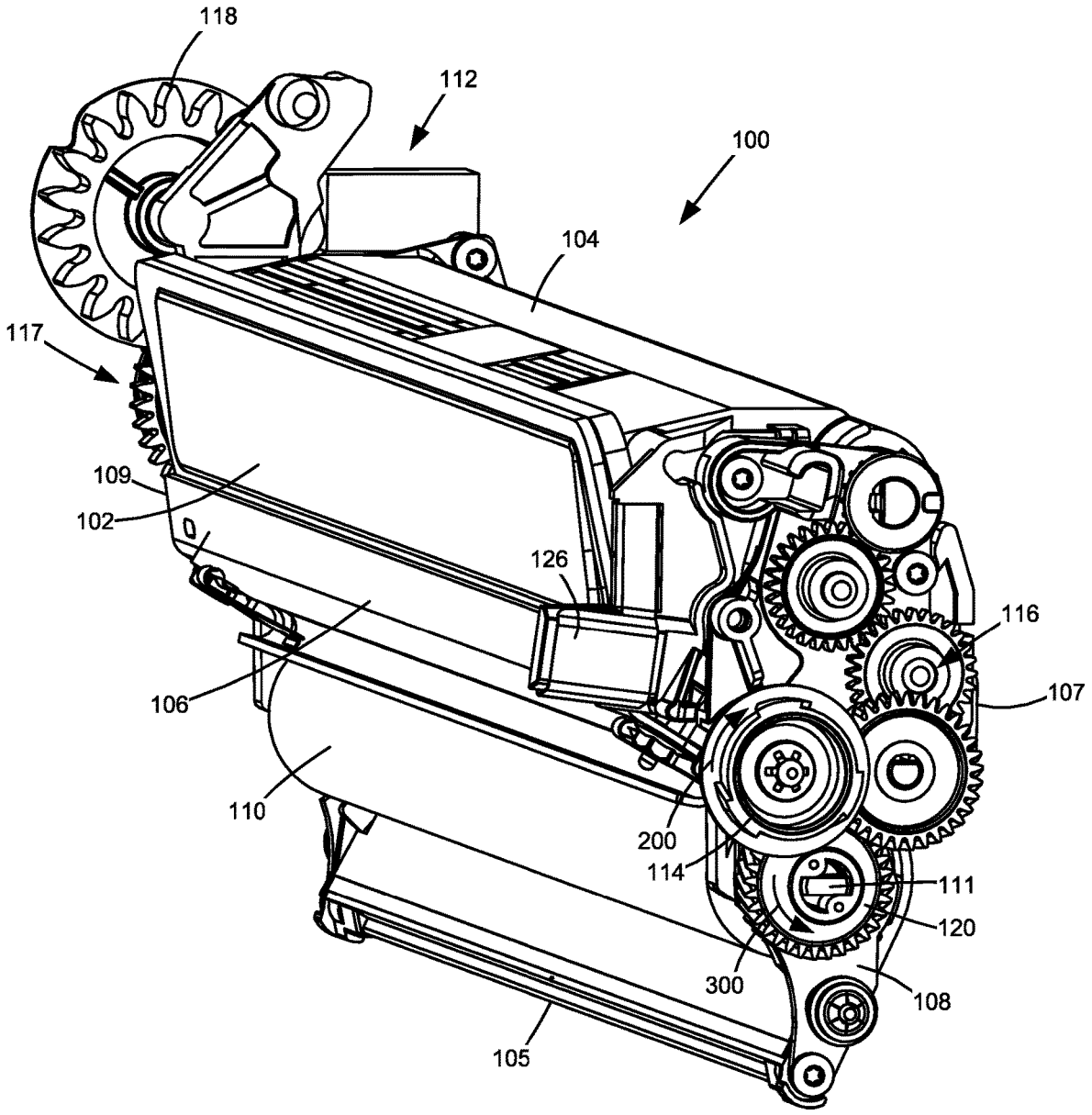
FIG. 1 is a perspective view of a developer unit for use in an electrophotographic image forming device according to one example embodiment.

FIG. 1 shows a replaceable developer unit 100 for use in an electrophotographic image forming device according to one example embodiment. Developer unit 100 includes a body 102 having a top 104, a bottom 105, a first side 106 and a second side 107. Top 104, bottom 105 and sides 106, 107 are positioned between a first end 108 and a second end 109 of body 102. Body 102 of developer unit 100 houses a toner reservoir and a toner development system. In the example embodiment illustrated, the toner development system utilizes what is commonly referred to as a single component development system. In this embodiment, developer unit 100 includes a toner adder roll that provides toner from the toner reservoir to a developer roll 110 and a doctor blade that provides a metered, uniform layer of toner on the in surface of developer roll 110.

The electrophotographic printing process is well known in the art and, therefore, is described briefly herein. During a printing operation, a charge roll charges the surface of a photoconductive drum to a predetermined voltage. A laser scan unit selectively discharges the surface of the photoconductive drum to create a latent image on the surface of the photoconductive drum. Developer roll 110 transfers toner from the toner reservoir of developer unit 100 to the latent image on the photoconductive drum to create a toned image on the surface of the photoconductive drum. The toned image is then transferred from the photoconductive drum to a media sheet for printing. Toner may be transferred directly to the media sheet by the photoconductive drum or by an intermediate transfer member that receives the toner from the photoconductive drum. A cleaner blade or roll removes any residual toner from the surface of the photoconductive drum after the toner is transferred from the photoconductive drum. The cleaned surface of the photoconductive drum is then ready to be charged again and exposed to the laser scan unit to continue the printing cycle. The photoconductive drum, the charge roll and the cleaner blade or roll may be provided in a replaceable unit for use in the image forming device, e.g., separately replaceable from developer unit 100 or integrated with developer unit 100.

In the example embodiment illustrated, developer unit 100 includes a toner inlet port 112 configured to receive toner from a corresponding toner cartridge, which contains the main toner supply of the image forming device, to replenish the toner reservoir of developer unit 100 during operation. In the embodiment illustrated, inlet port 112 is positioned at the top 104 of body 102 on end 109 of body 102; however, inlet port 112 may be positioned at any suitable location on developer unit 100. In other embodiments, instead of receiving toner from a toner cartridge, the toner reservoir of developer unit 100 may contain the main toner supply of the image forming device.

Developer roll 110 runs axially from end 108 to end 109 and is exposed on side 106 of body 102 in order to allow developer roll 110 to transfer toner to the photoconductive drum when developer unit 100 is installed in the image forming device. Developer unit 100 includes an input drive coupler 114 exposed on end 108 of body 102 to mate with and receive rotational force from a drive system of the image forming device when developer unit 100 is installed in the image forming device. In operation, drive coupler 114 rotates in an operative rotational direction 200. Drive coupler 114 is operatively connected by a. (hive train 116 on end 108 of body 102 to the rotatable components of developer unit 100 including, for example, developer roll 110, a toner adder roll that supplies toner in the reservoir of developer unit 100 to developer roll 110, and one or more toner agitators positioned in the reservoir of developer unit 100 that mix and move toner therein. In the example embodiment illustrated, an additional drive train 117 is operatively connected to drive coupler 114 and positioned on end 109 of body 102. Drive train 117 includes an output gear 118 positioned to mate with a corresponding input gear on a toner cartridge in order to transfer rotational motion to the components of the toner cartridge.

Figure 2:
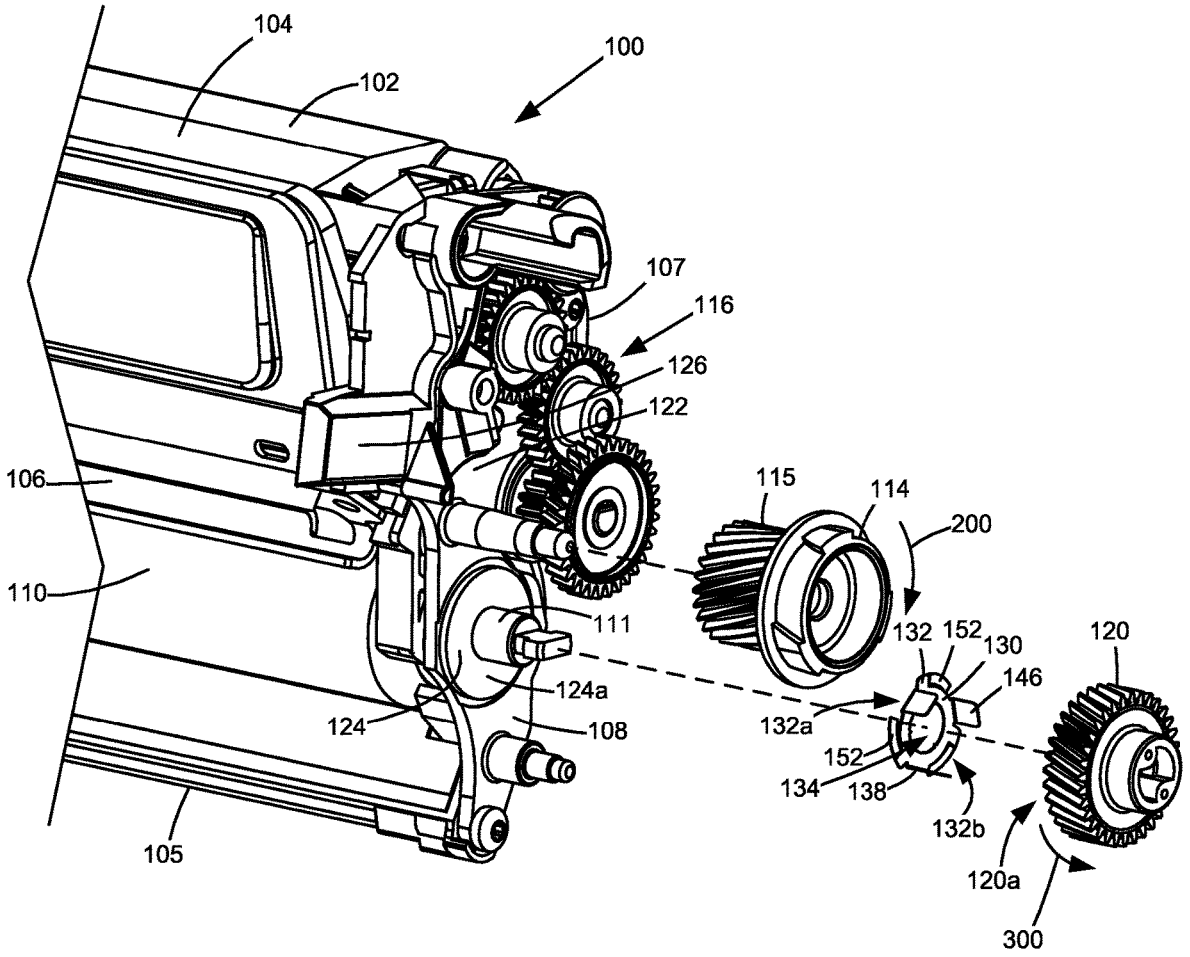
FIG. 2 is an exploded perspective view of the developer unit shown in FIG. 1 showing a drive train according to one example embodiment.

With reference to FIGS. 1 and 2, drive coupler 114 is operatively connected to a drive gear 120 of developer roll 110 in order to rotate developer roll 110 during operation of developer unit 100. Drive gear 120 is mounted coaxially on a shaft 111 of developer roll 110 such that developer roll 110 is rotatably coupled to drive gear 120. In operation, drive gear 120 and developer roll 110 rotate in an operative rotational direction 300. Shaft 111 of developer roll 110 is composed of an electrically conductive material, such as, for example, steel, including nickel plated low carbon steel. In the example embodiment illustrated, drive gear 120 meshes directly with a gear 115 formed integrally with and coaxial to drive coupler 114 allowing drive gear 120 to receive rotational force directly from drive coupler 114. In other embodiments, drive gear 120 may be rotatably connected to drive coupler 114 by one or more intermediate gears, such as gears of drive train 116, In the example embodiment illustrated, gear 115 of drive coupler 114 and drive gear 120 are helical gears such that rotation of drive gear 120 in operative rotational direction 300 by gear 115 of drive coupler 114 produces an inward axial force on drive gear 120, but other gear types may be used as desired.

In the example embodiment illustrated, developer unit 100 includes a gear plate 122 positioned at end 108 of body 102. Gear plate 122 supports and locates various components of drive train 116 including drive coupler 114 and drive gear 120. Gear plate 122 includes a bushing 124 that rotatably supports and locates shaft 111 of developer roll 110. In the embodiment illustrated, bushing 124 is formed separately from gear plate 122 and attached thereto. In other embodiments, bushing 124 may be formed integrally with gear plate 122. Bushing 124 is composed of an electrically conductive material, such as, for example, oil impregnated bronze. Gear plate 122 may also be composed of an electrically conductive material, such as, for example, die cast zinc.

Developer unit 100 includes an electrical contact 126 exposed on an exterior of body 102 to mate with and receive an electrical voltage from a corresponding electrical contact in the image forming device, which is electrically connected to a power supply of the image forming device, when developer unit 100 is installed in the image forming device. Bushing 124 is electrically connected to electrical contact 126, such as, for example, by gear plate 122. Contact between bushing 124 and shaft 111 of developer roll 110 provides an electrical voltage to developer roll 110 from the power source of the image forming device in order to facilitate the electrostatic transfer of toner from the surface of the toner adder roll to the surface of developer roll 110 and from the surface of developer roll 110 to the latent image on the surface of the photoconductive claim.

Developer unit 100 includes an electrical contact 130 positioned between an axially inboard side 120*a* of drive gear 120 and an axially outboard side 124*a* of bushing 124. Electrical contact 130 is composed of an electrically conductive material, such as, for example, stainless steel or phosphor bronze. As discussed in greater detail below, electrical contact 130 contacts both shaft 111 of developer roll 110 and bushing 124 in order to help ensure that a consistent electrical connection is maintained between shaft 111 of developer roll 110 and bushing 124.

With reference to FIGS. 2 and 3A-3C, electrical contact 130 includes a body 132 composed of an electrically conductive material. Body 132 includes an axially inboard side 132*a* that faces away from drive gear 120 and toward bushing 124, and an axially outboard side 132*b* that faces away from bushing 124 and toward drive gear 120. An opening 134 formed through body 132 is sized and shaped to closely receive shaft 111 of developer roll 110 such that shaft 111 of developer roll 110 contacts body 132. In the embodiment illustrated, opening 134 is generally circular corresponding to the circular cross section of the example shaft 111 illustrated. In other embodiments, opening 134 and shaft 111 may have other shapes, such as, for example, a D-shaped cross section, During assembly of developer unit 100, shaft 111 of developer roll 110 is press fit into opening 134 of electrical contact 130. In the embodiment illustrated, body 132 of electrical contact 130 includes one or more projections 136, such as spikes or prongs, that extend into opening 134. Projections 136 are positioned to have an interference fit with an outer diameter of shaft 111 of developer roll 110 in order to ensure that contact is maintained between shaft 111 and electrical contact 130. In the embodiment illustrated, electrical contact 130 includes three projections 136; however, more or fewer projections 136 may be used as desired.

With reference to FIGS. 3A-3C, 4 and 5, electrical contact 130 includes one or more mounting tabs 138 that attach electrical contact 130 to drive gear 120 so that electrical contact 130 remains substantially stationary relative to drive gear 120, for example, so that electrical contact 130 does not rotate relative to drive gear 120 or shaft 111 of developer roll 110 during operation. In the embodiment illustrated, electrical contact 130 includes a mounting tab 138 that includes a pair of arms 140, 141 each extending in a cantilevered manner from axially outboard side 132*b* of body 132 toward drive gear 120. Arms 140, 141 are resiliently deflectable and spaced circumferentially from each other forming a gap 142 therebetween. In the embodiment illustrated, drive gear 120 includes one or more support ribs 144 positioned on axially inboard side 120*a* of drive gear 120.

Figure 4:
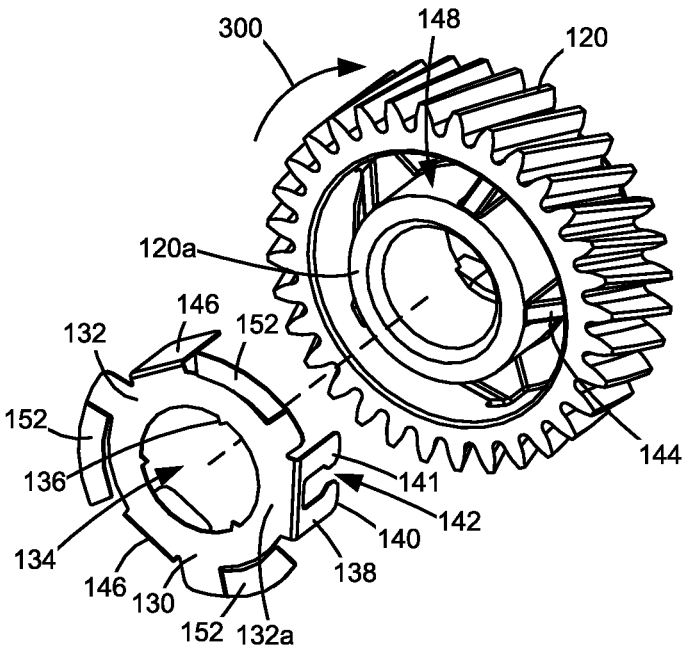
FIG. 4 is an exploded perspective view of the electrical contact aligned with a drive gear of the developer unit according to one example embodiment.
Figure 5:
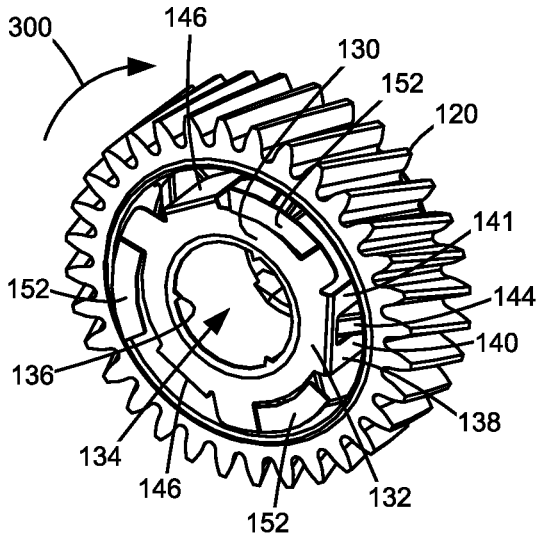
FIG. 5 is a perspective view of the electrical contact installed on the drive gear of the developer unit according to one example embodiment.

Electrical contact 130 may be manually installed on drive gear 120 by aligning opening 134 of electrical contact 130 with a rotational axis of drive gear 120 and mounting tab 138 with a support rib 144 of drive gear 120 as shown in FIG. 4, and pressing axially outboard side 132*b* of body 132 of electrical contact 130 against axially inboard side 120*a* of drive gear 120 with the support rib 144 positioned between arms 140, 141 of mounting tab 138. Mounting tab 138 has an interference fit with support rib 144 causing arms 140, 141 to deflect away from each other when electrical contact 130 is pressed onto drive gear 120 allowing support rib 144 to enter gap 142 between arms 140, 141, The interference fit between aims 140, 141 and support rib 144 retains electrical contact 130 on drive gear 120. Contact between arms 140, 141 and support rib 144 and between projections 136 and shaft 111 of developer roll 110 ensures that electrical contact 130 does not rotate relative to drive gear 120 or shaft 111 of developer roll 110 during operation. FIG. 5 shows electrical contact 130 mounted on drive gear 120 with mounting tab 138 attached to a support rib 144 of drive gear 120.

Figure 3A:
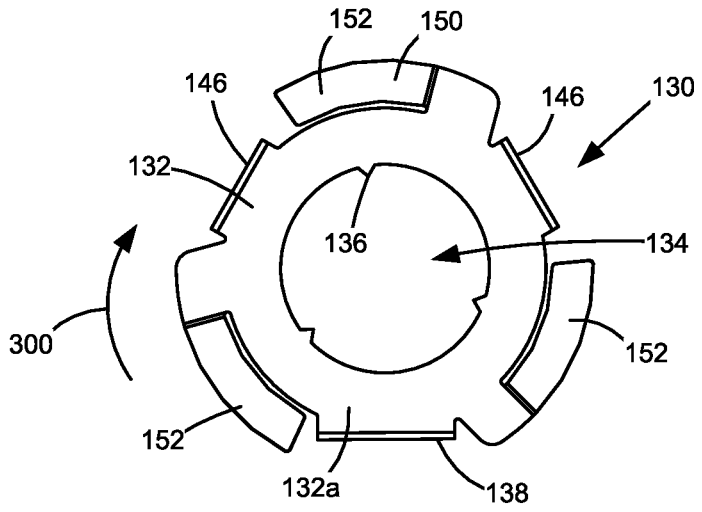
FIG. 3A is a first elevation view of an electrical contact of the developer unit according to one example embodiment.
Figure 3B:
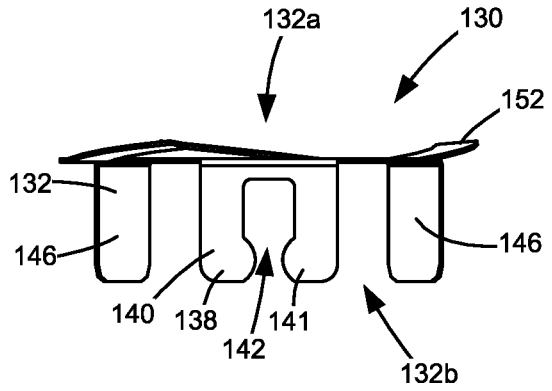
FIG. 3B is a second elevation view of the electrical contact shown in FIG. 3A.
Figure 3C:
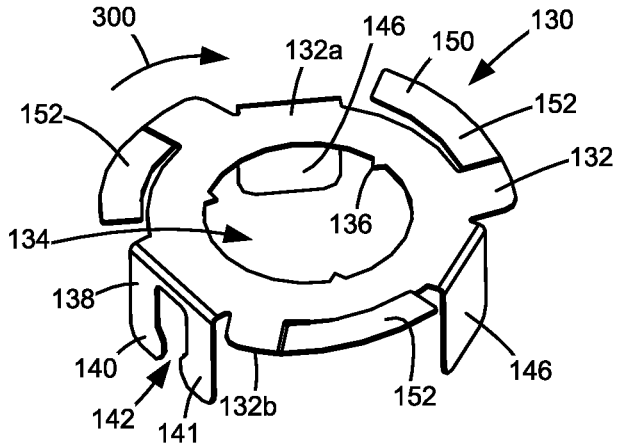
FIG. 3C is a perspective view of the electrical contact shown in FIGS. 3A and 3B.

With continued reference to FIGS. 3A-3C. 4 and 5, in the embodiment illustrated, electrical contact 130 also includes one or more alignment tabs 146 extending in a cantilevered manner from axially outboard side 132*b* of body 132 of electrical contact 130 toward drive gear 120. Alignment tabs 146 are aligned with and received by gaps 148 formed between support ribs 144 on axially inboard side 120*a* of drive gear 120 when electrical contact 130 is installed on drive gear 120. Alignment tabs 146 help an installation technician align electrical contact 130 rotationally with drive gear 120 during installation of electrical contact 130 onto drive gear 120. Alignment tabs 146 and mounting tab 138 also prevent electrical contact 130 from being installed in an inverted alignment relative to bushing 124 and drive gear 120. For example, if an installation technician mistakenly attempts to install drive gear 120 onto shaft 111 of developer roll 120 with axially inboard side 132*a* of electrical contact 130 facing drive gear 120 instead of bushing 124, alignment tabs 146 and mounting tab 138 will contact bushing 124 preventing drive gear 120 from installing on shaft 111 of developer roll 110.

Electrical contact 130 includes one or more contact members 150 that contact bushing 124 to electrically connect electrical contact 130 with bushing 124. In the embodiment illustrated, electrical contact 130 includes one or more contact arms 152 that extend in a cantilevered manner from axially inboard side 132*a* of body 132 toward bushing 124. In this embodiment, contact arms 152 extend circumferentially counter to operative rotational direction 300 of drive gear 120 and developer roll 110 and axially inward, away from drive gear 120 and toward bushing 124, such that the amount of extension axially inward toward bushing 124 of each contact arm 152 increases in a direction counter to operative rotational direction 300 of drive gear 120 and developer roll 110. In the embodiment illustrated, electrical contact 130 includes three contact arms 152 in order to ensure that contact is maintained between contact arms 152 and bushing 124; however, more or fewer contact arms 152 may be used as desired.

Electrical contact 130 provides an additional electrical connection between bushing 124 and shaft 111 of developer roll 110 in order to help ensure that a consistent electrical connection is maintained between bushing 124 and shaft 111 of developer roll 110. When developer roll 110 rotates during operation of developer unit 100, the direct electrical contact between shaft 111 of developer roll 110 and bushing 124 can be susceptible to disruptions, for example, due to debris in the interface between shaft 111 and bushing 124 and/or variations in the force on developer roll 110 from contact with the photoconductive drum, the toner adder roll and the doctor blade. An intermittent or irregular electrical voltage to shaft 111 of developer roll 110 can result in print defects such as the appearance of light horizontal lines or bands on the printed page. The additional electrical connection between bushing 124 and shaft 111 of developer roll 110 provided by electrical contact 130 helps ensure that a consistent electrical connection is maintained between bushing 124 and shall 111 of developer roll 110 during operation. Where drive gear 120 is a helical gear, as in the example embodiment illustrated, the inward axial force on drive gear 120 (toward gear plate 122) dining rotation of drive gear 120 in operative rotational direction 300 helps force contact arms 152 against bushing 124 so that electrical contact is maintained between contact arms 152 and axially outboard side 124*a* of bushing 124 during operation.

Figure 6:
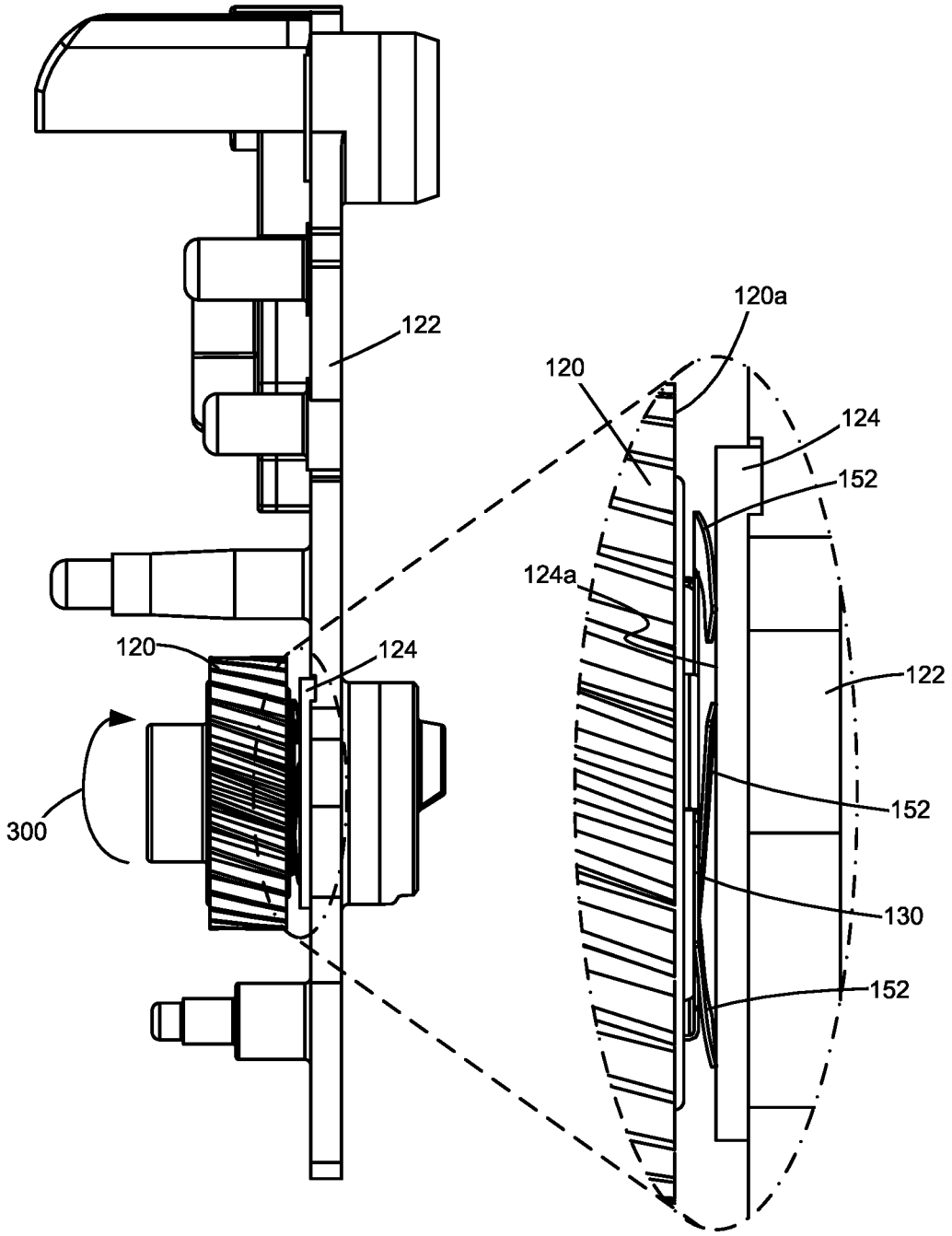
FIG. 6 is an elevation view of a gear plate of the developer unit showing the electrical contact installed on the drive gear and in contact with a bushing on the gear plate according to one example embodiment.

The extension of contact arms 152 axially toward bushing 124 counter to operative rotational direction 300 of drive gear 120 and developer roll 110 in the embodiment illustrated also helps sweep or scrape debris from axially outboard side 124*a* of bushing 124 during rotation of electrical contact 130. In this manner, in addition to providing an electrical connection between bushing 124 and shaft 111, contact between contact arms 152 and bushing 124 also helps clear debris from bushing 124 when electrical contact 130 rotates with drive gear 120 and shaft 111. For example, FIG. 6 shows electrical contact 130 sandwiched between axially outboard side 124*a* of bushing 124 and axially inboard side 120*a* of drive gear 120 and illustrates the contact between contact arms 152 of electrical contact 130 and axially outboard side 124*a* of bushing 124.

Figure 7A:
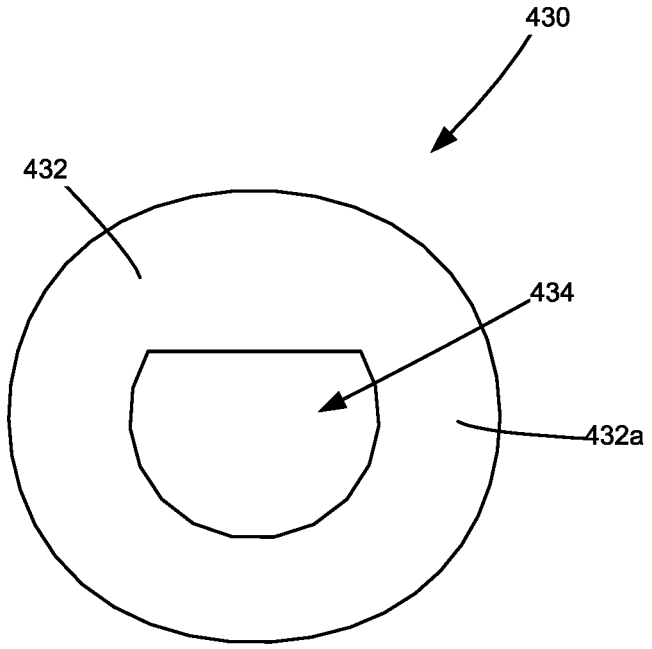
FIG. 7A PRIOR ART
FIG. 7A is a first elevation view of a prior art electrical contact.
Figure 7B:
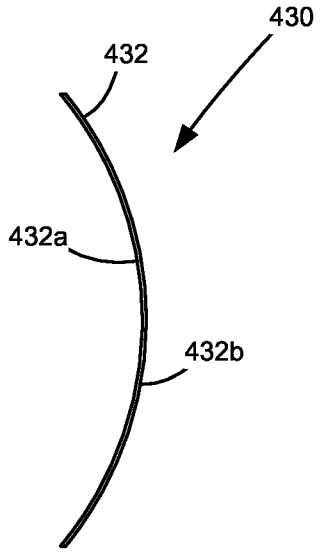
FIG. 7B PRIOR ART
FIG. 7B is a second elevation view of the prior art electrical contact shown in FIG. 7A.
Figure 7C:
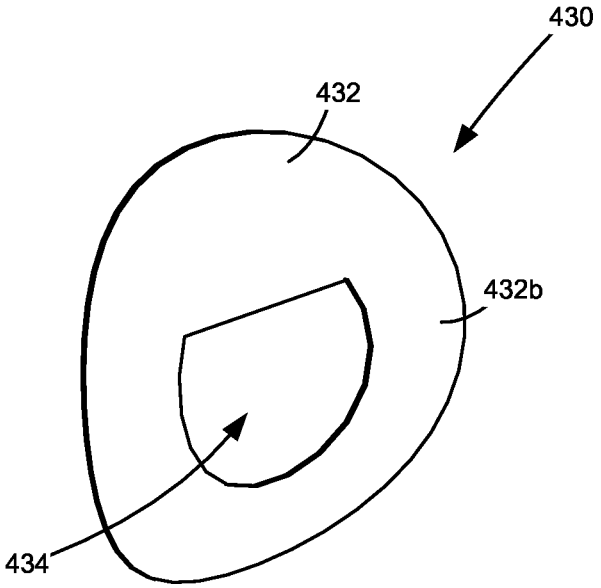
FIG. 7C PRIOR ART
FIG. 7C is a perspective view of the prior art electrical contact shown in FIGS. 7A and 7B.

FIGS. 7A-7C show a prior art electrical contact 430 for use with a developer unit. Electrical contact 430 is configured to be sandwiched between an axially outboard side of a bushing that supports rotation of a shaft of a developer roll and an axially inboard side of a drive gear mounted on the shaft of the developer roll. Electrical contact 430 is configured to provide an additional electrical connection between the bushing and the shaft of the developer roll. Electrical contact 430 includes a body 432 composed of an electrically conductive material and having an axially inboard side 432*a* and an axially outboard side 432*b*.

A D-shaped opening 434 formed through body 432 is sized and shaped to closely receive a corresponding D-shaped shaft of the corresponding developer roll. The engagement between D-shaped opening 434 and the corresponding D-shaped shaft of the developer roll ensures that electrical contact 430 does not rotate relative to the shaft of the developer roll or the corresponding drive gear during operation.

As shown in FIGS. 7B and 7C, body 432 of electrical contact 430 has the shape of a flat washer that is bent or curved at the top and bottom of body 432 to form a substantially C-shaped profile when viewed from the side. The curved shape of body 432 of electrical contact 430 provides a spring force when electrical contact 430 is sandwiched between the axially outboard side of the bushing and the axially inboard side of the drive gear that helps electrical contact 430 maintain contact with the axially outboard side of the bushing during operation.

Opening 134 of electrical contact 130 discussed above may be sized and shaped to accommodate a variety of different shaft geometries, including a shaft having a circular cross section, in comparison with electrical contact 430 which is limited to a non-circular opening 434. As discussed above, contact between mounting tab 138 and support rib 144 ensures that electrical contact 130 does not rotate relative to drive gear 120 or shaft 111 of developer roll 110 during operation. Contact between projections 136 and shaft 111 of developer roll 110 also helps ensure that electrical contact 130 does not rotate relative to drive gear 120 or shaft 111 of developer roll 110 during operation. Electrical contact 430, on the other hand, would be susceptible to relative motion between electrical contact 430 and the shaft of the developer roll and the corresponding drive gear if electrical contact 430 were modified to include a circular opening 434 instead of a D-shaped opening to accommodate a shaft having a circular cross section.

Electrical contact 130 discussed above also tends to provide a more consistent and reliable electrical connection between bushing 124 and shaft 111 of developer roll 110 in comparison with electrical contact 430. As discussed above, the interference fit between projections 136 of electrical contact 130 and an outer diameter of shaft 111 help ensure that contact is maintained between shaft 111 and electrical contact 130. In contrast, contact between electrical contact 430 and a corresponding shaft relies entirely on the engagement between the surface of body 432 forming opening 434 and the shaft. Contact between contact arms 152 of electrical contact 130 and bushing 124 also provides an improved electrical connection between electrical contact 130 and bushing 124 in comparison with electrical contact 430 and helps clear debris from bushing 124 when electrical contact 130 rotates with drive gear 120 and shaft 111 so that a reliable electrical connection between electrical contact 130 and bushing 124 is maintained.

While the example embodiment discussed above includes an electrical contact 130 that provides an electrical connection between a bushing 124 and a shaft 111 of a rotatable developer roll 110, it will be appreciated that electrical contact 130 may be used to provide an electrical connection between any suitable bushing and rotatable component as desired. It will also be appreciated that the architecture of developer unit 100 and the components thereof, including developer roll 110, drive gear 120, gear plate 122, bushing 124, and electrical contact 130, discussed above are merely examples and are not intended to be limiting. The replaceable units and components of an image forming device may include many different configurations and architectures. Further, the image forming device may utilize a single developer unit, such as developer unit 100, in the case of a monochrome image forming device, or multiple developer units may be used in the case of a color image forming device.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. An assembly, comprising:

a rotatable component having an electrically conductive shaft that defines a rotational axis of the rotatable component;

a gear mounted on and rotatable with the shaft;

an electrically conductive bushing rotatably supporting the shaft; and an electrical contact positioned between the bushing and the gear, the electrical contact is composed of an electrically conductive material and contacts the shaft and the bushing to provide an electrical connection between the shaft and the bushing, the shaft of the rotatable component extends through an opening in the electrical contact, the electrical contact includes a mounting tab that extends axially relative to the rotational axis toward the gear, the mounting tab attaches the electrical contact to the gear such that the electrical contact is rotatably coupled to the gear.

2. The assembly of claim 1, wherein the electrical contact is positioned between an axially inboard side of the gear and an axially outboard side of the bushing.

3. The assembly of claim 1, wherein the mounting tab includes a pair of arms extending axially relative to the rotational axis toward the gear.

4. The assembly of claim 3, wherein the arms receive a support rib of the gear therebetween to attach the electrical contact to the gear.

5. The assembly of claim 1, wherein the electrical contact includes a contact arm that extends in a cantilevered manner toward the bushing and contacts the bushing.

6. An assembly, comprising:

a rotatable component having an electrically conductive shaft that defines a rotational axis of the rotatable component;

a gear mounted on and rotatable with the shaft;

an electrically conductive bushing rotatably supporting the shaft; and an electrical contact positioned between the bushing and the gear, the electrical contact is composed of an electrically conductive material and contacts the shaft and the bushing to provide an electrical connection between the shaft and the bushing, the shaft of the rotatable component extends through an opening in the electrical contact, the electrical contact is rotatable with the shaft and the gear, the electrical contact includes a contact arm that extends in a cantilevered manner toward the bushing and contacts the bushing, the contact arm extends axially along the rotational axis toward the bushing and circumferentially counter to an operative rotational direction of the shaft and the gear allowing the contact arm to clear debris from the bushing when the electrical contact rotates in the operative rotational direction of the shaft and the gear.

7. The assembly of claim 6, wherein the electrical contact is positioned between an axially inboard side of the gear and an axially outboard side of the bushing.

8. The assembly of claim 6, wherein the electrical contact is attached to the gear.

9. The assembly of claim 8, wherein the electrical contact includes a mounting tab that extends axially relative to the rotational axis toward the gear and attaches the electrical contact to the gear.

10. The assembly of claim 9, wherein the mounting tab includes a pair of arms extending axially relative to the rotational axis toward the gear.

11. The assembly of claim 10, wherein the arms receive a support rib of the gear therebetween to attach the electrical contact to the gear.

12. The assembly of claim 6, wherein the electrical contact includes a plurality of contact arms, each of the plurality of contact arms extends in a cantilevered manner toward the bushing and contacts the bushing, each of the plurality of contact arms extends axially along the rotational axis toward the bushing and circumferentially counter to the operative rotational direction of the shaft and the gear.

13. An electrical contact, comprising:

a body composed of an electrically conductive material, the body has an axially inboard side and an axially outboard side;

an opening through the body for closely receiving a shaft of a rotatable component;

a mounting tab extending from the axially outboard side of the body for attaching the body to a rotatable gear to rotatably couple the electrical contact to the gear; and a contact arm extending in a cantilevered manner from the axially inboard side of the body for contacting a bushing that rotatably supports the shaft to provide an electrical connection between the bushing and the shaft.

14. The electrical contact of claim 13, wherein the mounting tab includes a pair of arms extending in a cantilevered manner from the axially outboard side of the body for receiving a corresponding support rib of the gear to attach the body to the gear.

15. The electrical contact of claim 13, wherein the contact arm extends axially along a rotational axis of the electrical contact and circumferentially counter to an operative rotational direction of the electrical contact.

16. The electrical contact of claim 13, wherein the contact arm includes a plurality of contact arms, each of the plurality of contact arms extends in a cantilevered manner from the axially inboard side of the body for contacting the bushing.

17. The electrical contact of claim 16, wherein each of the plurality of contact arms extends axially along a rotational axis of the electrical contact and circumferentially counter to an operative rotational direction of the electrical contact.

* * * * *